US011177604B2

(12) United States Patent
Tsutsui

(10) Patent No.: US 11,177,604 B2
(45) Date of Patent: Nov. 16, 2021

(54) CONNECTOR HOUSING AND CONNECTOR

(71) Applicant: Tyco Electronics Japan G.K., Kawasaki (JP)

(72) Inventor: Yuki Tsutsui, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/722,002

(22) Filed: Dec. 20, 2019

(65) Prior Publication Data

US 2020/0203875 A1 Jun. 25, 2020

(30) Foreign Application Priority Data

Dec. 21, 2018 (JP) ..... JP2018-239169

(51) Int. Cl.
*H01R 13/422* (2006.01)
*H01R 4/18* (2006.01)
*H01R 13/11* (2006.01)

(52) U.S. Cl.
CPC ..... *H01R 13/4223* (2013.01); *H01R 4/185* (2013.01); *H01R 13/11* (2013.01)

(58) Field of Classification Search
CPC ..... H01R 13/4226; H01R 13/6272; H01R 13/4367; H01R 13/4368; H01R 13/11; H01R 4/185
See application file for complete search history.

(56) References Cited

U.S. PATENT DOCUMENTS 5,470,258 A * 11/1995 Suzuki ..... H01R 13/4223 439/595
6,305,992 B1 * 10/2001 Bouda ..... H01R 13/113 439/834
7,168,981 B2 * 1/2007 Takahashi ..... H01R 13/4223 439/595
7,942,708 B2 5/2011 Ohsako
9,509,077 B2 * 11/2016 Lihoshi ..... H01R 13/4223
10,193,263 B2 * 1/2019 Nagasaka ..... H01R 13/6271
10,804,639 B2 * 10/2020 Masuda ..... H01R 13/533
10,826,221 B2 * 11/2020 Chiba ..... H01R 13/4223
2013/0072061 A1 * 3/2013 Morikawa ..... H01R 4/70 439/587
2015/0333427 A1 * 11/2015 Taguchi ..... H01R 13/428 439/748
2020/0099160 A1 * 3/2020 Masuda ..... H01R 13/516

FOREIGN PATENT DOCUMENTS

JP 2010103049 A 5/2010
JP 2011124172 A 6/2011
WO WO-2018110228 A1 * 6/2018 ..... H01R 13/533

OTHER PUBLICATIONS

Abstract of JP 2011124172, dated Jun. 23, 2011, 1 page.

* cited by examiner

*Primary Examiner* — Renee S Luebke
*Assistant Examiner* — Paul D Baillargeon
(74) *Attorney, Agent, or Firm* — Barley Snyder

(57) ABSTRACT

A lance of a connector housing includes a pressed portion disposed at a free end of the lance, a buckling portion disposed closer to a fixed end of the lance opposite the free end than the pressed portion, and a buckling resisting portion disposed between the pressed portion and the buckling portion. The buckling portion buckles when a force exceeding a predetermined tolerance limit is applied to the pressed portion and the buckling resisting portion permits the buckling portion to buckle while reducing buckling of the pressed portion.

13 Claims, 1 Drawing Sheet

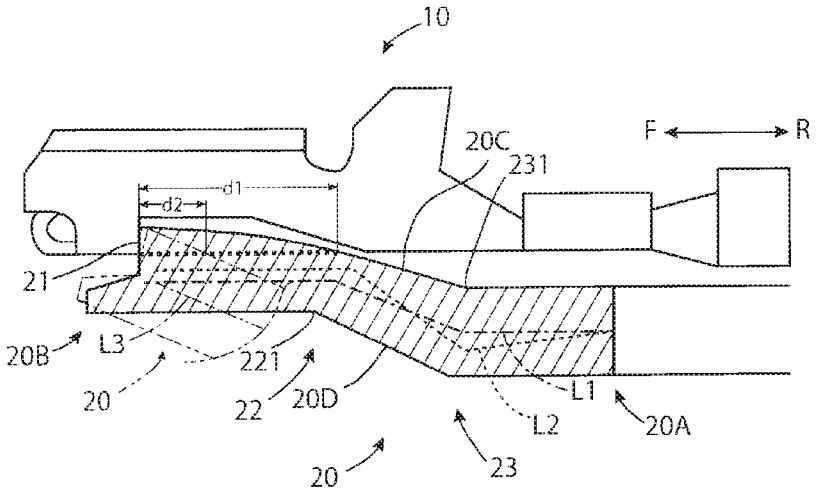
10
F
R
20C
231
d1
d2
21
20B
L3
221
20
22
20D
L1
L2
20A
20
23

CONNECTOR HOUSING AND CONNECTOR

CROSS-REFERENCE TO RELATED APPLICATION

This application claims the benefit of the filing date under 35 U.S.C. § 119(a)-(d) of Japanese Patent Application No. 2018-239169, filed on Dec. 21, 2018.

FIELD OF THE INVENTION

The present invention relates to a connector housing and, more particularly, to a connector housing having a lance that prevents a contact from being pulled out.

BACKGROUND

In a connector in which a contact connected to an electric wire is disposed within a housing, a force may be applied to the electric wire in such a direction as to pull the contact out of the housing. A lance of the connector resists such a force to prevent the contact from being pulled out. The ability of such a lance provided in a connector housing to withstand a pull-out force depends upon restrictions such as dimensions.

Japanese Patent Application No. 2010-103049A discloses an electric connector preventing deformation of a lance provided in a housing. The function of preventing deformation of the lance, however, depends on the presence of a mating connector. The deformation prevention function effectively acts in a state where the connector is mated with the mating connector, but the function of preventing deformation of the lance is low with a single connector in a non-mated state.

SUMMARY

A lance of a connector housing includes a pressed portion disposed at a free end of the lance, a buckling portion disposed closer to a fixed end of the lance opposite the free end than the pressed portion, and a buckling resisting portion disposed between the pressed portion and the buckling portion. The buckling portion buckles when a force exceeding a predetermined tolerance limit is applied to the pressed portion and the buckling resisting portion permits the buckling portion to buckle while reducing buckling of the pressed portion.

BRIEF DESCRIPTION OF THE DRAWINGS

The invention will now be described by way of example with reference to the accompanying FIGURES, of which:

FIG. 1 is a schematic diagram of a lance of a connector housing and a contact according to an embodiment.

DETAILED DESCRIPTION OF THE EMBODIMENT(S)

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

A lance 20 of a connector housing and a contact 10, according to an embodiment, are shown in FIG. 1. In the shown and described embodiment, a description and illustration of the connector housing as a whole is omitted, as the description pertains to the lance 20 of the connector housing as shown in FIG. 1. The lance 20 is hatched in FIG. 1; this hatching does not indicate a cross-section of the lance 20 but is intended to show a shape of the lance 20 for ease of understanding.

In the shown embodiment, the contact 10 is a female contact. In other embodiments, the contact 10 could be a male contact.

The contact 10 is inserted into the connector housing in a frontward direction F in FIG. 1. A lance 20 provided in the connector housing, and formed integrally with the connector housing, engages with the contact 10. An electric wire is connected to the contact 10 and extends in a rearward direction R. The lance 20 has a fixed end 20A in the rearward direction R, extends forward in a cantilever shape in the frontward direction F, and has a free end 20B at a front end portion of the lance 20.

A force is applied to the electric wire, connected to the contact 10, in the rearward direction R to pull out the contact 10 from the connector housing. The lance 20 prevents the contact 10 from being pulled out rearward when such a force is applied to the contact 10. A description is given here of a case where a force exceeding a tolerance limit is applied to the lance 20.

In the embodiment shown in FIG. 1, the lance 20 has a pressed portion 21, a buckling resisting portion 22, and a buckling portion 23.

The pressed portion 21, as shown in FIG. 1, is provided at the free end 20B. The pressed portion 21 is pressed by the contact 10 when a force acts on the contact 10 in such a direction as to pull the contact 10 out in the rearward direction R. In various embodiments, the pressed portion 21 may be at a distance from the contact 10 before the action of such a force or may abut the contact 10 before the action of such a force.

The buckling portion 23, as shown in FIG. 1, is provided closer to the fixed end 20A than the pressed portion 21. When a force exceeding a predetermined tolerance limit is applied to the pressed portion 21, the buckling portion 23 buckles. A first surface 20C of the buckling portion 23 that extends in a front-rear direction F-R and faces toward the contact 10 bends in a concave shape in a direction away from the contact 10 with respect to the front-rear direction F-R; the buckling portion 23 has a first bend section 231 on the first surface 20C. The first bend section 231 does not need to have linear sections but, in another embodiment, may be a round surface with respect to the front-rear direction F-R. By having the first bend section 231, the buckling portion 23 has such a shape as to induce buckling when the pressed portion 21 of the lance 20 is pressed by a force exceeding the tolerance limit.

As shown in FIG. 1, the buckling resisting portion 22 is disposed between the pressed portion 21 and the buckling portion 23 in the front-rear direction F-R. The buckling resisting portion 22 allows buckling to occur closer to the buckling portion 23 while reducing buckling closer to the pressed portion 21. A second surface 20D of the buckling resisting portion 22 extends in the front-rear direction F-R and faces away from the contact 10. The second surface 20D bends in a concave shape in a direction toward the contact 10 with respect to the front-rear direction F-R. The buckling resisting portion 22 has a second bend section 221 on the second surface 20D. As is the case with the first bend section 231, the second bend section 221 does not need to have linear sections but, in another embodiment, may be a round surface with respect to the front-rear direction F-R. With the second bend section 221, the buckling resisting portion 22 easily buckles in a direction toward the contact 10 when the pressed portion 21 of the lance 20 is pressed by a force exceeding the tolerance limit. By having the second bend section 221, the buckling resisting portion 22 prevents buckling of the buckling portion 23 from affecting the pressed portion 21 when the buckling portion 23 buckles.

A line L1 indicated by a dot-and-dash line in FIG. 1 is drawn substantially in the center of the lance 20 in a thickness direction. When a force exceeding the tolerance limit is applied to the pressed portion 21 and the buckling portion 23 buckles, the line L1 transforms into a line L2 indicated by a dotted line. Buckling of the buckling portion 23 affects the buckling resisting portion 22, but prevented by the buckling resisting portion 22 from affecting the pressed portion 21. In this case, the pulling out of the contact 10 is resisted by a wide shear area over a length d1 along the front-rear direction F-R.

A lance having no buckling resisting portion 22 is now considered with reference to the same signs as the lance 20 having the buckling resisting portion 22. In FIG. 1, a tip portion of the lance 20 having no buckling resisting portion 22 during buckling of the buckling portion 23 is indicated by a chain double-dashed line L3. When the buckling portion 23 of the lance 20 having no buckling resisting portion 22 buckles, the buckling affects the pressed portion 21 as indicated by the chain double-dashed line L3. In this embodiment, the pulling out of the contact 10 is resisted by a narrow shear area over a length d2 along the front-rear direction. That is, the contact 10 is pulled out with a smaller pull-out force than in the case of the lance 20 having the buckling resisting portion 22. The provision of the buckling resisting portion 22 between the pressed portion 21 and the buckling portion 23 in the lance of the disclosed embodiment makes it possible to withstand a strong pull-out force.

In another embodiment, a connector includes a connector housing having the lance 20 and the contact 10 inserted into the connector housing.

What is claimed is:

1. A lance of a connector housing, comprising:

a pressed portion disposed at a free end of the lance;

a buckling portion disposed closer to a fixed end of the lance opposite the free end than the pressed portion, the buckling portion having a first surface extending in a front-rear direction and facing toward the contact, the first surface bends in a concave shape in a direction away from the contact and defines a first bend section, the buckling portion buckling when a force exceeding a predetermined tolerance limit is applied to the pressed portion; and a buckling resisting portion disposed between the pressed portion and the buckling portion, the buckling resisting portion having a second surface extending in the front-rear direction and facing away from the contact, the second surface bends in a concave shape in a direction toward the contact and defines a second bend section, a thickness of the lance between the first and second surfaces tapers between the first bend section and the second bend section such that the buckling resisting portion permits the buckling portion to buckle while reducing buckling of the pressed portion.

2. The lance of claim 1, wherein the pressed portion is pressed by a contact disposed in the connector housing when a force acts on the contact in a rearward direction opposite to a frontward direction in which the contact is inserted in the connector housing.

3. The lance of claim 2, wherein the pressed portion is disposed at a distance from the contact before the force acting on the contact is applied in the rearward direction.

4. The lance of claim 2, wherein the pressed portion abuts the contact before the force acting on the contact is applied in the rearward direction.

5. The lance of claim 2, wherein the lance extends in a cantilever shape in the frontward direction.

6. The lance of claim 2, wherein the pressed portion defines a continuous vertical wall over its length that is pressed by the contact when a force acts on the contact in a rearward direction opposite to a frontward direction in which the contact is inserted in the connector housing.

7. The lance of claim 1, wherein the first bend section is defined by two adjoining linear sections of the first surface.

8. The lance of claim 7, wherein the first surface extends continuously linearly between the first bend section and the fixed end of the lance.

9. The lance of claim 8, wherein the second bend section is defined by two adjoining linear sections of the second surface.

10. The lance of claim 9, wherein the second surface extends continuously linearly between the second bend section and the buckling portion.

11. A connector housing, comprising:

a lance extending in a cantilever shape in a frontward direction in which a contact is inserted in the connector housing, the lance engaging the contact and including a pressed portion disposed at a free end of the lance, a buckling portion disposed closer to a fixed end of the lance opposite the free end than the pressed portion, the buckling portion having a first surface extending in a front-rear direction and facing toward the contact, the first surface bends in a concave shape in a direction away from the contact and defines a first bend section, and a buckling resisting portion disposed between the pressed portion and the buckling portion, the buckling portion having a second surface extending in the front-rear direction and facing away from the contact, the second surface bends in a concave shape in a direction toward the contact and defines a second bend section, a thickness of the lance between the first and second surfaces tapers between the first bend section and the second bend section such that the buckling portion buckles when a force exceeding a predetermined tolerance limit is applied to the pressed portion and the buckling resisting portion permits the buckling portion to buckle while reducing buckling of the pressed portion.

12. The connector housing of claim 11, wherein the pressed portion is pressed by the contact when a force acts on the contact in a rearward direction opposite to the frontward direction.

13. A connector, comprising:

a connector housing including a lance extending in a cantilever shape in a frontward direction, the lance including a pressed portion disposed at a free end of the lance, a buckling portion disposed closer to a fixed end of the lance opposite the free end than the pressed portion, and a buckling resisting portion disposed between the pressed portion and the buckling portion; and a contact inserted in the connector housing in the frontward direction, the pressed portion is pressed by the contact when a force acts on the contact in a rearward direction opposite to a frontward direction, the buckling portion having a first surface extending in a front-rear direction and facing toward the contact, the first surface bends in a concave shape in a direction away from the contact and defines a first bend section, the buckling portion buckles when a force exceeding a predetermined tolerance limit is applied to the pressed portion and the buckling resisting portion permits the buckling portion to buckle while reducing buckling of the pressed portion, the buckling resisting portion having a second surface extending in the front-rear direction and facing away from the contact, the second surface bends in a concave shape in a direction toward the contact and defines a second bend section, a thickness of the lance between the first and second surfaces tapers between the first bend section and the second bend section.

* * * * *